US009347749B2

(12) United States Patent
Olah

(10) Patent No.: US 9,347,749 B2
(45) Date of Patent: May 24, 2016

(54) FASHIONABLE, COMPACT, WEARABLE, INSTANT USE PEPPER SPRAY SELF-DEFENSE ACCESSORY

(71) Applicant: Little Viper, LLC, Hebron, IN (US)

(72) Inventor: Caroline Olah, Hebron, IN (US)

(73) Assignee: Little Viper, Inc., Sedro Woolley, WA (US)

( * ) Notice: Subject to any disclaimer, the term of this patent is extended or adjusted under 35 U.S.C. 154(b) by 5 days.

(21) Appl. No.: 14/622,539

(22) Filed: Feb. 13, 2015

(65) Prior Publication Data

US 2015/0233681 A1 Aug. 20, 2015

Related U.S. Application Data

(60) Provisional application No. 61/942,350, filed on Feb. 20, 2014.

(51) Int. Cl.

| | |
|---|---|
| ***F41H 9/10*** | (2006.01) |
| ***A44C 5/18*** | (2006.01) |
| ***A44C 5/00*** | (2006.01) |

(52) U.S. Cl.

CPC *F41H 9/10* (2013.01); *A44C 5/003* (2013.01); *A44C 5/0053* (2013.01)

(58) Field of Classification Search

CPC ..... F41H 9/10; A44C 5/003; A44C 5/0053
USPC ..... 222/78, 175, 394
See application file for complete search history.

(56) References Cited

U.S. PATENT DOCUMENTS

| | | | | | |
|---|---|---|---|---|---|
| 4,058,237 | A * | 11/1977 | Luke | F41H 9/10 | 222/175 |
| 4,241,850 | A * | 12/1980 | Speer | F41H 9/10 | 116/214 |
| 5,358,144 | A | 10/1994 | Mock | | |
| 5,924,601 | A * | 7/1999 | Chen | F41H 9/10 | 222/175 |
| 6,123,228 | A * | 9/2000 | Hippensteel | A44C 9/0053 | 222/153.11 |
| 6,126,041 | A * | 10/2000 | DiTomasso | A45F 3/20 | 222/175 |
| 7,135,011 | B2 * | 11/2006 | Powers | A45D 34/00 | 604/310 |
| 8,286,834 | B2 * | 10/2012 | Powers | A45D 34/00 | 222/175 |
| 8,517,896 | B2 * | 8/2013 | Robinette | A63B 24/00 | 377/24.2 |
| 2007/0066088 | A1 * | 3/2007 | Rambosek | H05K 5/0278 | 439/37 |
| 2012/0282011 | A1 * | 11/2012 | Francois | A61L 2/18 | 401/196 |

* cited by examiner

*Primary Examiner* — Nicholas J Weiss
(74) *Attorney, Agent, or Firm* — Kevin Keener; Keener and Associates P.C.

(57) ABSTRACT

The present invention includes self-defense apparatus comprising a wristband, an upper compartment with a circular recess attached to the wristband, and a clasp system. The upper compartment holds a small cylindrical canister containing a self-defense spray, the nozzle of the canister aligns with the circular recess. The wristband is comprised of an inner end and an outer end. The clasp system is comprised of an outer portion and an inner portion, wherein the outer portion is located on the outer end of the wristband, and the inner portion located on the inner end of the wristband. The outer portion of the clasp system attaches to the inner portion of the clasp system.

10 Claims, 3 Drawing Sheets

FASHIONABLE, COMPACT, WEARABLE, INSTANT USE PEPPER SPRAY SELF-DEFENSE ACCESSORY

PRIORITY

This application claims the benefit of U.S. Provisional Application No. 61/942,350, filed Feb. 20, 2014.

FIELD OF THE INVENTION

The present invention relates generally to self-defense apparatus, and more particularly to a wristband adapted to contain a canister of pepper spray or other type of self-defense repellants.

BACKGROUND OF INVENTION

In the current society, it is often necessary to take precautions to protect oneself in the event that a dangerous situation arises. There are often news stories about women or men who attacked while jogging or walking at night. It is often advisable to carry some type of self-protection device. There currently exist several means for protection, including carrying weapons, whistles, or various types of self-defense sprays.

Issues arise when these devices are actually needed because they are usually not easily accessible to a person in a dangerous situation. For example, if a person was mugged, or attacked from behind by an assailant, it is unlikely that they would have the time or opportunity to reach in their purse or pocket to obtain whatever means of protection they may be carrying. It is also well known that in some instances weapons can actually be retrieved by the attacker and used on the person carrying the weapon. Several attempts have been made to alleviate the drawbacks of carrying weapons.

First, attempts have been made to utilize a holster to attach the weapon to a person's body. This method is difficult and undesirable to some, as holstering a weapon discreetly requires one to wear baggy clothes to remain inconspicuous. Further, to carry a gun, a permit is needed which is a big deterrent to most individuals. Finally, a large percentage of individuals shy away from carrying deadly weapons because the weapons may be used against them. Other options include carrying self-defense sprays to ward off an attacker, however, it is sometimes difficult to obtain the spray when under attack, and therefore these devices may prove useless in a dangerous situation. What is needed is a self-defense spray, which is easily accessible and attached to the body so that in dangerous situations it may be accessed without compromising the safety of the user.

U.S. Pat. No. 5,358,144 to Mock is directed toward solving these issues. However, Mock does not go far enough. Mock discloses the use of an activation button to release a repellant. However, the use of a single activation button runs the risk of inadvertent release. The present invention presents an improvement over Mock in that the present invention requires the user to use two fingers to squeeze a compartment to release the repellant. This presents an improvement in that it significantly reduces the likelihood of inadvertent release of the repellant.

SUMMARY OF INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The invention is directed toward a wearable self-defense apparatus comprising a wristband, an upper compartment centrally located and attached to the top side of said wristband, and a clasp system. It is further envisioned that the upper compartment has a first end, a second end, and an upper curved surface. The first and second end of the upper compartment have a ridged surface, and the upper curved surface of the upper compartment has a circular recess located near the first end of the upper compartment.

Further, the upper compartment holds a small cylindrical canister containing a self-defense spray. The canister has a top portion, a bottom portion, and a nozzle. The top portion of the canister aligning with the first end of the upper compartment, the bottom portion of the canister aligning with the second end of the lower compartment, and the nozzle of the canister aligning with the circular recess.

The wristband is comprised of an inner end and an outer end. The clasp system is comprised of an outer portion and an inner portion, the outer portion located on the outer end of the wristband, the inner portion located on the inner end of the wristband. Finally, the outer portion of the clasp system attaches to the inner portion of the clasp system.

In another embodiment of the present invention, the self-defense apparatus is comprised of a flexible, waterproof, material adapted to stretch and form around a user's wrist. It is further envisioned that the material is synthetic rubber. In yet another embodiment, the material is silicone rubber. In another embodiment of the present invention, the clasp system is comprised of aluminum, metal, or stainless steel. In other embodiments of the present invention, the outer portion of the clasp system consists of one clasp. It is further envisioned in other embodiments that the inner portion of the clasp system consists of three clasps.

In another embodiment of the present invention, the length of the wristband is between 7 and 10 inches. It is also envisioned in other embodiments, that the length of the wristband is 8.5 inches.

Finally, the present invention envisions a method of using a self-defense apparatus to protect against attack from an assailant comprising: pointing the self-defense apparatus towards the assailant, the apparatus having an upper compartment with a first end, a second end, and an upper curved surface encompassing a canister of self-defense spray. Grasping the first and second end of the upper compartment simultaneously with an index finger and a thumb while pointing towards the assailant, and dispensing the self-defense spray from a circular recess on the upper compartment towards the assailant.

Still other objects of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE PREFERRED EMBODIMENT

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

Figure 1:
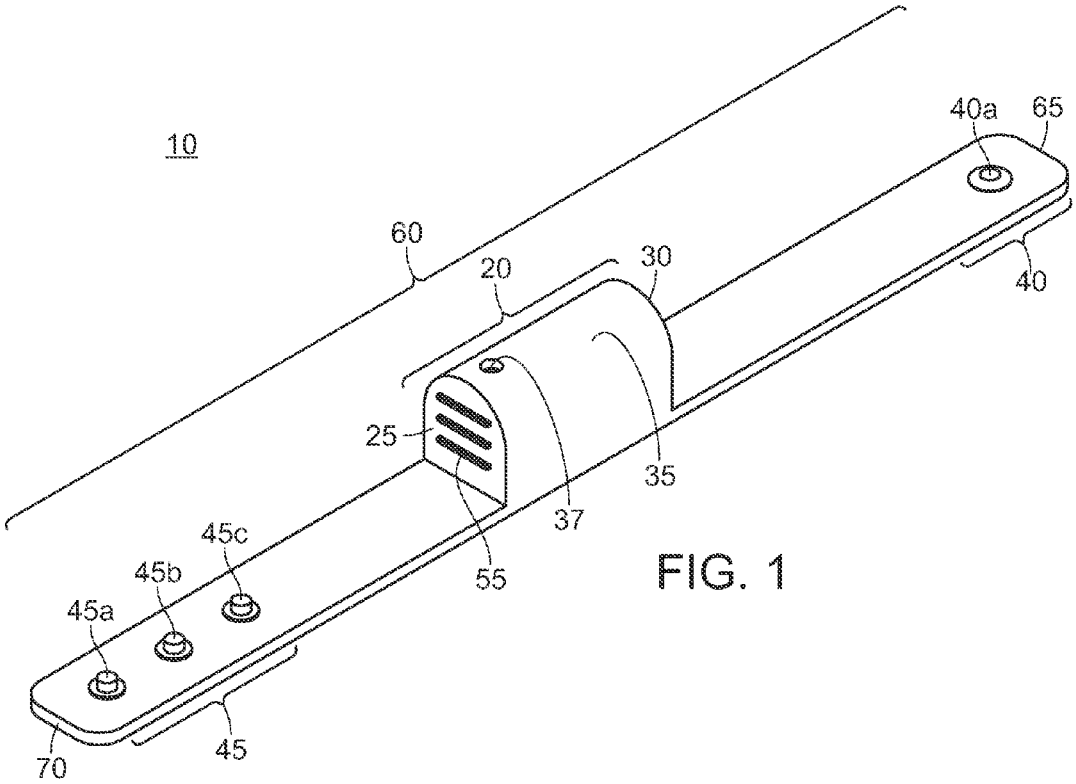
FIG. 1 is a perspective view of the apparatus in the present invention.
Figure 2:
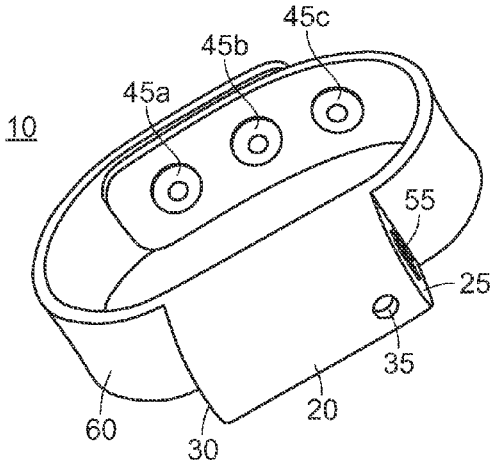
FIG. 2 is a perspective view of the apparatus of FIG. 1 in the present invention.
Figure 3:
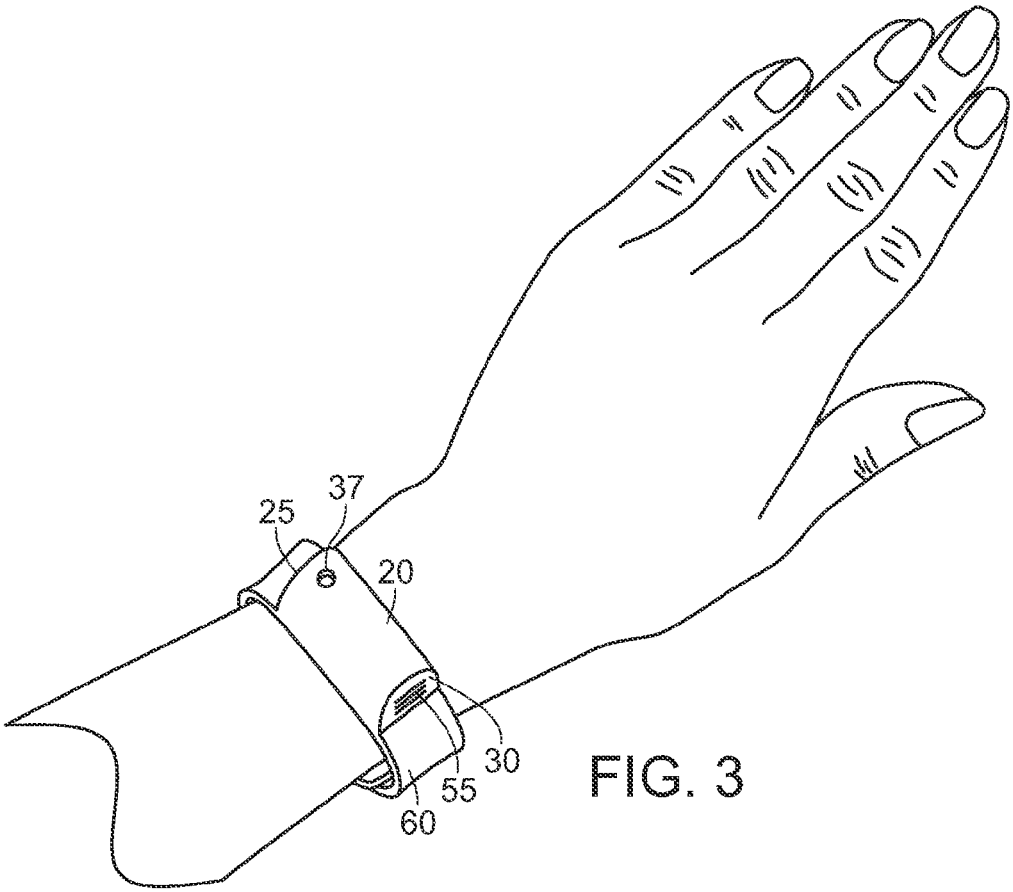
FIG. 3 is a perspective view of a user's arm equipped with the apparatus in the present invention.
Figure 4:
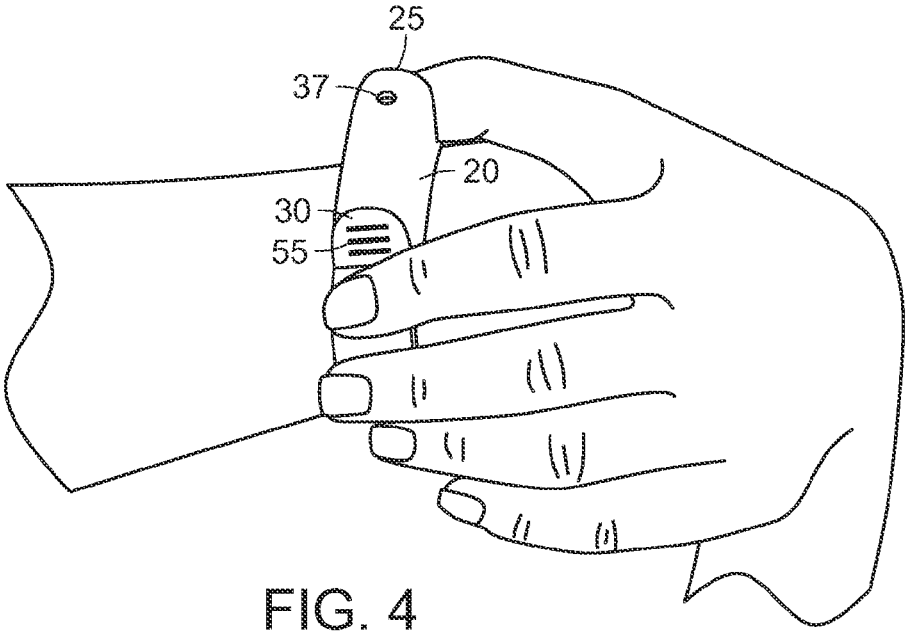
FIG. 4 is a perspective view of the apparatus on a user's arm illustrating a method of using the apparatus in the present invention.

FIGS. 1 through 4 depict the self-defense apparatus in different embodiments. FIG. 1 is a perspective view of the apparatus in the open, uninstalled position. FIG. 2 is a perspective view of the apparatus in the closed position. FIG. 3 is a perspective view of the apparatus as worn by a user in the closed position. FIG. 4 is a perspective view of the apparatus on a user's arm illustrating a method of using the apparatus in the present invention.

FIG. 1 is a perspective view of the self-defense apparatus 10. The apparatus 10 is in the open position. The apparatus 10, consists of a wristband 60, an upper compartment 20, and a clasp system. The self-defense apparatus 10 is designed to protect a user from an assailant by allowing the user to spray the assailant with a self-defense spray, such as pepper spray or mace, when under attack.

The self-defense apparatus 10 has an outer end 65 and an inner end 70. The outer end 65, is designed to overlap and attach to the inner end 70 and secure the self-defense apparatus 10 in place on a user's arm. The outer end 65 and inner end 70 attach together using a clasp system. The clasp system is comprised of an outer portion 40 located on the outer end 65 of the self-defense apparatus 10 and an inner portion 45, located on the inner end 70, of the self-defense apparatus 10. The outer portion 40 and inner portion 45 of the clasp system connect together and secure the self-defense apparatus 10 in place.

The self-defense apparatus 10 is manufactured of a material designed to move and stretch as necessary to allow for a comfortable fit on the users arm. The material is waterproof and could be any type of thermoplastic or synthetic rubber material now known or later discovered. In the present embodiment, the material used is silicone rubber, but any suitable type of material could be used if it served the same purpose.

The outer portion 40 of the clasp system consists of one clasping component 40*a*, but it is envisioned that more than one component could be used if necessary. The inner portion 45 of the clasp system consists of three clasping components 45*a*, 45*b*, 45*c* in this embodiment. The three clasping components 45*a*, 45*b*, 45*c*, are designed to accommodate a varied range of wrist sizes. In the present embodiment, the length of the self-defense apparatus is 8.5 inches, but the length could vary as necessary.

The outer portion 40 and inner portion 45 of the clasp system may be manufactured of several different types of material, including but not limited to: aluminum, various types of stainless steel, of any other suitable material now known or later discovered which serves the purpose necessary to allow the clasp system to function properly.

The upper compartment 20 has a first end 25, a second end 30, and a curved upper surface 35. The first end 25, has a circular recess 37 located in the top portion of the upper curved surface 35. The upper compartment 20, is hollow and designed to hold a canister of self-defense spray such as pepper spray, mace or any other type of spray now known or later discovered. The first end 25 of the upper compartment 20 is a solid surface with ridges 55 designed to assist a user in gripping the first end 25, the second end 30 of the upper compartment 20 is also a solid surface with ridges 55 designed to assist a user in gripping the second end 30.

The upper compartment 20 is designed to encompass a can of self-defense spray. This is accomplished by inserting the self-defense spray into the hollow upper compartment 20. The first end 25 accepts the top of the self-defense spray, the second end 30 accepts the bottom portion of the self-defense spray. The nozzle portion of the self-defense spray aligns with the circular recess 37. The first end 25 and second end 30 of the upper compartment 20 attach together via bonding, welding, injection molding or any other type of connection means necessary to encompass the self-defense spray within the upper compartment 20.

FIGS. 2 and 3 are perspective views of the self-defense apparatus 10 in the closed position. FIG. 2 depicts the self-defense apparatus 10 in the closed position by itself. FIG. 3 is a depiction of the self-defense apparatus as worn by a user. To install the self-defense apparatus 10, the user places the open apparatus on the wrist. The inner portion 45 is adjusted to the proper fit necessary for ease and comfort. The outer portion 40 is then placed on one of the inner clasping components 45*a*, 45*b*, or 45*c*, and secured in place by attaching the outer clasping component 40*a* on the outer portion 40 to the inner clasping component 45*a*, 45*b*, or 45*c*. The self-defense apparatus 10 once secured will remain in place on the user's wrist. The user of the self-defense apparatus is free to engage in daily activities as the self-defense apparatus 10, is waterproof, sweat proof, and weather proof.

FIG. 4 depicts a user operating the self-defense apparatus 10. In a situation where the user feels operation of the apparatus is necessary, the user may grasp the first end 25 using a thumb and second end 30 using an index finger, and compress both the first end 25 and the second end 30 simultaneously.

Once pressed the self-defense spray contained internally within the upper compartment 20 will eject a spray from the circular recess 37 towards the assailant. The user may then exit the premises away from the assailant and head to a safer area. The self-defense apparatus 10 may be formed such that it may be used only once, or may be reloaded with a new bottle of self-defense spray by disengaging the first end 25 and second end 30 of the upper compartment 20.

Figure 5:
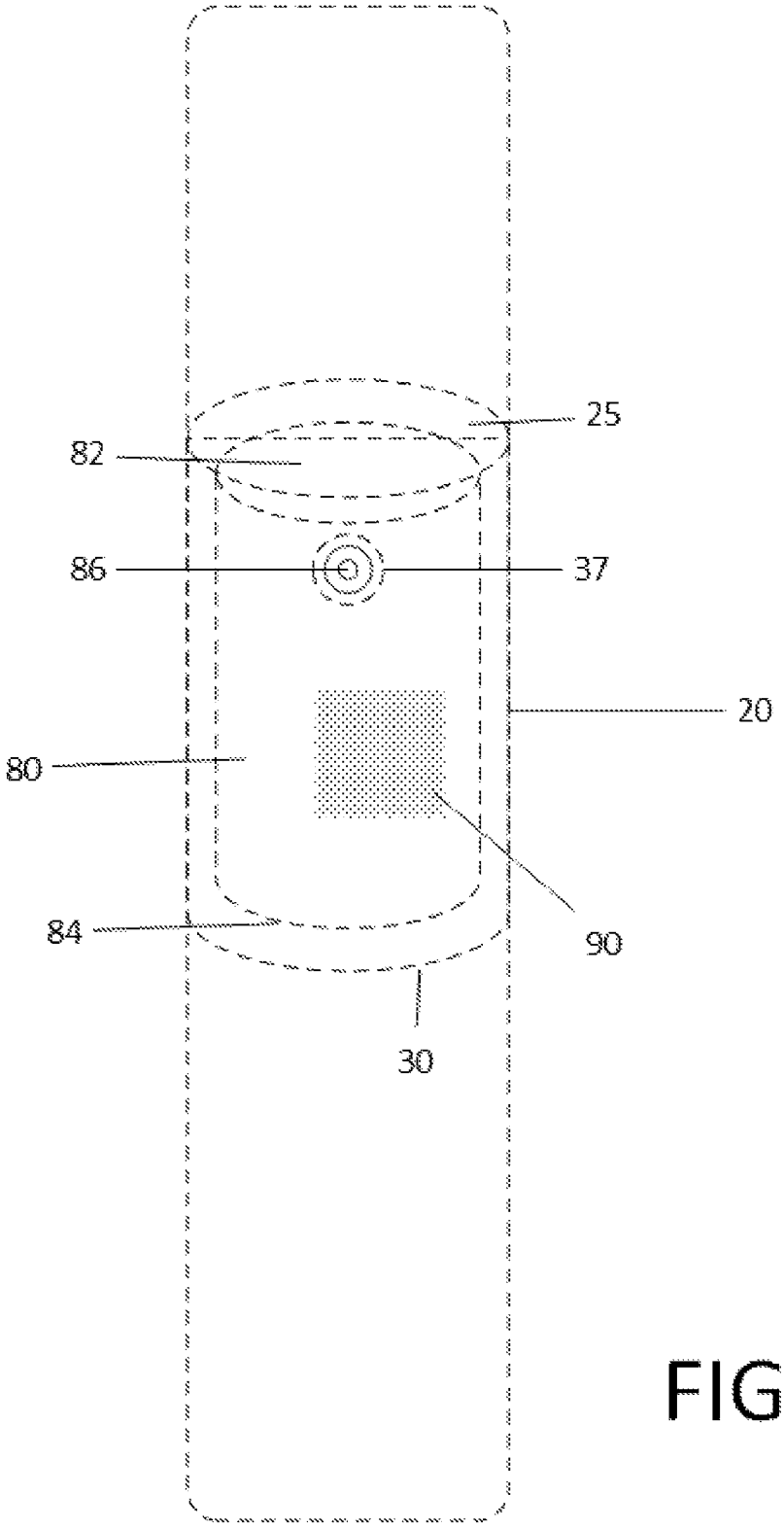
FIG. 5 is a plan view of the canister of self-defense spray in the apparatus.

Referring to FIG. 5, the canister 80 is displayed within the upper compartment 20. The canister 80 is a cylindrical canister containing a self-defense spray 90. The canister 80 has a top portion 82, a bottom portion 84, and a nozzle 86. The top portion 82 of the canister 80 is aligned with the first end 25 of the upper compartment 20. The bottom portion 84 of the canister 80 is aligned with the second end 30 of the upper compartment 20. The nozzle 86 is aligned with the circular recess 37.

It is further envisioned that the self-defense apparatus may be of different lengths to accommodate locating the device on different body parts. For example, the device may be located around the waist of a user for discreetness and ease of use. Other locations may include the upper arm, thigh or associated locations.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The invention claimed is:

1. A wearable self-defense apparatus comprising: a wristband having a top side and a bottom side, an upper compartment centrally located and attached to the top side of said wristband, and a clasp system;

wherein said upper compartment has a first end, a second end, and an upper curved surface;

wherein said first and second end of said upper compartment have a ridged surface, and said upper curved surface of said upper compartment has a circular recess located in said upper compartment;

wherein said upper compartment holds a small cylindrical canister containing a self-defense spray, said canister having a top portion, a bottom portion, and a nozzle, said top portion of said canister aligning with said first end of said upper compartment, said bottom portion of said canister aligning with said second end of said upper compartment, said nozzle of said canister aligning with said circular recess;

wherein said wristband is comprised of an inner end and an outer end;

wherein said clasp system is comprised of an outer portion and an inner portion, said outer portion located on said outer end of said wristband, said inner portion located on said inner end of said wristband;

wherein said outer portion of said clasp system attaches to said inner portion of said clasp system.

2. The apparatus of claim 1, wherein said self-defense apparatus is comprised of a flexible, waterproof, material adapted to stretch and form around a user's wrist.

3. The apparatus of claim 2, wherein said material is synthetic rubber.

4. The apparatus of claim 3, wherein said material is silicone rubber.

5. The apparatus of claim 4, wherein said clasp system is comprised of aluminum, metal, or stainless steel.

6. The apparatus of claim 5, wherein said outer portion of said clasp system consists of one clasp.

7. The apparatus of claim 6, wherein said inner portion of said clasp system consists of three clasps.

8. The apparatus of claim 7, wherein the length of said wristband is between 7 and 10 inches.

9. The apparatus of claim 8, wherein the length of said wristband is 8.5 inches.

10. A wearable self-defense apparatus comprising: a wristband having a top side and a bottom side, an upper compartment, and a clasp system;

wherein said upper compartment is centrally located and formed from said wristband;

wherein, said upper compartment has a first end, a second end, and an upper curved surface;

wherein said first and second end of said upper compartment have a ridged surface, and a top of said upper compartment has a circular recess;

wherein said upper compartment contains a canister of self-defense spray having a top portion, a bottom portion, and a nozzle, said top portion of said canister aligning with said first end of said upper compartment, said bottom portion of said canister aligning with said second end of said upper compartment and said nozzle aligning with said circular recess;

wherein said wristband is comprised of an outer end and an inner end;

wherein said clasp system comprises an outer portion and an inner portion, said outer portion located on said outer end of said wristband, said inner portion located on said inner end of said wristband;

wherein said outer portion of said clasp system connects to said inner portion of said clasp system;

wherein said self-defense apparatus is comprised of a flexible, waterproof, silicone rubber material adapted to stretch and form comfortably around the wrist of a user wherein said clasp system is comprised of aluminum, metal, or stainless steel;

wherein said self-defense apparatus is 8.5 inches in length.

* * * * *